US005193902A

United States Patent [19]

Hyland et al.

[11] Patent Number: 5,193,902

[45] Date of Patent: Mar. 16, 1993

[54] UNIVERSAL FOLDABLE LAMP SHADE COVER

[76] Inventors: Joseph F. Hyland; Barbara B. Hyland, both of 3298 Casey Key Rd., Nokomis, Fla. 34275

[21] Appl. No.: 879,778

[22] Filed: May 5, 1992

Related U.S. Application Data

[63] Continuation-in-part of Ser. No. 621,594, Dec. 3, 1990, Pat. No. 5,121,312.

[51] Int. Cl.[5] ..... F21V 1/06

[52] U.S. Cl. ..... 362/352; 362/357; 362/457; 362/806

[58] Field of Search ..... 362/351-361, 362/457, 806

[56] References Cited

U.S. PATENT DOCUMENTS 4,646,216 2/1987 Chong et al. ..... 362/352

4,731,715 3/1988 Anderson ..... 362/352

*Primary Examiner*—Allen M. Ostrager

*Attorney, Agent, or Firm*—Charles J. Prescott

[57] ABSTRACT

A universal foldable lamp shade cover which includes a uniformly pleated rectangular sheet of thin, somewhat rigid yet bendable material having a plurality of side-by-side slender elongated panels integrally connected one to another in accordion fashion along a fold line between each panel. The side margins of the pleated sheet are connected to form a somewhat tubular member which is sized, when reduced in circumference at its upper end, to be held in place primarily by a strip of double-sided adhesive tape adhered on one side around the upper perimeter opening of a lamp shade. The lamp shade cover is then adhered in position over the lamp shade to the exposed surface of the adhesive transfer tape.

9 Claims, 2 Drawing Sheets

UNIVERSAL FOLDABLE LAMP SHADE COVER

BACKGROUND OF THE INVENTION

This application is a continuation-in-part of U.S. patent application Ser. No. 07/621,594, filed Dec. 30, 1990, now U.S. Pat. No. 5,121,312.

This invention is generally related to lamp shades, and more particularly to a removable, universal, foldable lamp shade cover.

The construction of conventional lamp shades is well known and typically require replacement long before the lamp itself is either worn or desired to be replaced for decorative considerations. However, in replacing a conventional lamp shade, both size and decorative considerations become somewhat restrictive in selecting a replacement.

Additionally, seasonal or festive considerations may make it desirable to temporarily alter the appearance of one or more lamp shades in a room or home setting.

One such device for accomplishing this is disclosed in U.S. Pat. No. 4,731,715 to Anderson which is directed to a conformable covering fabricated from a rectangular swath of cloth which may be fitted over a conventional lamp shade.

Other uniquely constructed lamp shades and lamp shade covers are as follows:

| | |
|---|---|
| Gottlieb | 3,161,358 |
| Washick | 3,385,963 |
| Weisbrod | 4,055,760 |
| Gall | 4,354,222 |
| Payne | 4,625,268 |
| Naumoff, et al. | 4,727,461 |

However, none of these references is of a nature similar to that of the present invention.

The present invention provides a universal, foldable lamp shade cover which may be manufactured from any convenient semi-rigid decorative material which is formed into a uniformly pleated rectangular sheet bendable primarily about the fold lines between each slender panel in accordion fashion. This structure includes a drawstring adjacent the upper end and has sufficient pliability about the fold lines so as to conform to a broad range of lamp shade sizes of perimeters and lengths and shapes. Moreover, the device is structured in one embodiment so as to rest atop a tapered lamp shade held thusly primarily by gravity, requiring no additional connecting means between the device and the lamp shade. This invention will also function and be retained atop a cylindrical or straight-sided lamp shade as well. Compact storage is also provided.

BRIEF SUMMARY OF THE INVENTION

This invention is directed to a universal foldable lamp shade cover which includes a uniformly pleated rectangular sheet of thin, somewhat rigid yet bendable material having a plurality of side-by-side slender elongated panels integrally connected one to another in accordion fashion along a fold line between each panel. The side margins of the pleated sheet are connected to form a somewhat tubular member which is sized, when reduced in circumference at its upper end, to be held in place primarily by a strip of double-sided acrylic adhesive transfer tape adhered on one surface thereof onto the upper perimeter opening of a lamp shade. The lamp shade cover is then adhered in position over the lamp shade to the exposed surface of the adhesive transfer tape.

It is therefore an object of this invention to provide a universal, foldable lamp shade cover which may be fabricated from a virtually limitless selection of semi-rigid, bendable decorative materials.

It is another object of this invention to provide a universal lamp shade cover which will decoratively cover a conventional lamp shade, thus providing a completely different decorative lamp shade appearance without the need for lamp shade replacement.

It is yet another object of this invention to provide a universal lamp shade cover which is expandable to fit over and cover a very broad range of lamp shade sizes of perimeters and lengths and shapes.

It is yet another object of this invention to provide a universal lamp shade cover which may substantially alter the decorative length configuration of a conventional lamp shade.

It is yet another object of this invention to be compactly storable.

In accordance with these and other objects which will become apparent hereinafter, the instant invention will now be described with reference to the accompanying drawings.

DETAILED DESCRIPTION OF THE INVENTION

Figure 1:
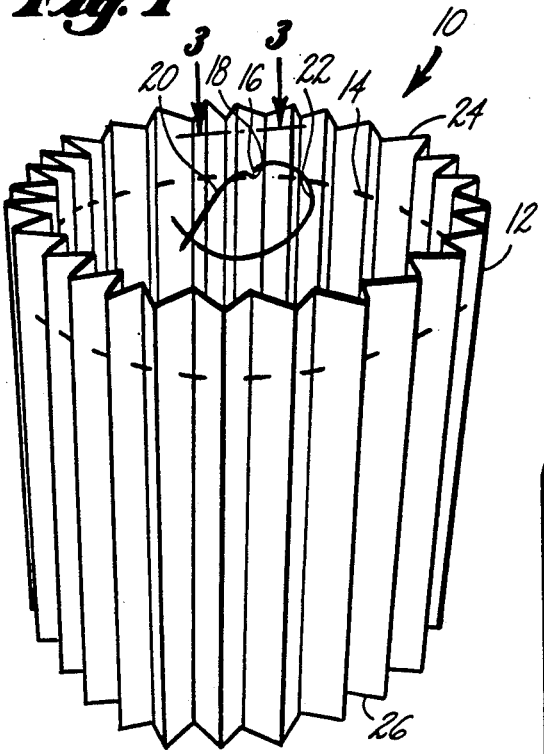
FIG. 1 is a perspective view of the preferred embodiment of the invention in its relaxed configuration.

Referring now to the drawings, and particularly to FIG. 1, the preferred embodiment of the invention is shown generally at numeral 10. This lamp shade cover 10 is fabricated of a pleated sheet 12 formed of relatively stiff, yet foldable decorative material sufficiently rigid so as to maintain a free-standing shape as shown in FIG. 1, yet sufficiently pliable so as to be expandable in accordion fashion.

Figure 3:
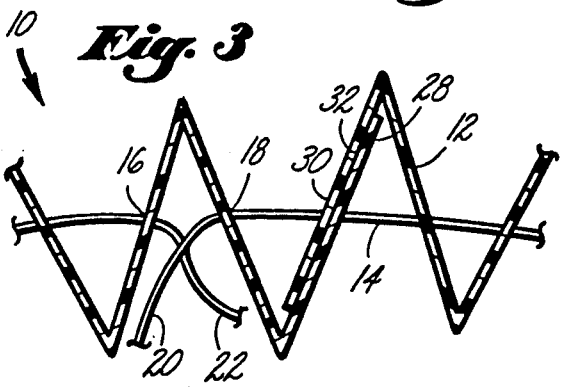
FIG. 3 is a section view in the direction of arrows 3—3 in FIG. 1.

Referring additionally to FIG. 3, edge panels 28 and 30 of pleated sheet 12 are overlapped and adhered together along surface 32 by conventional adhesive, double-sided adhesive tape, sewn seam, or the like so as to form the generally tubular-shaped member depicted in FIG. 1.

A drawstring 14 formed of a length of thin, flexible cord material is positioned in in-and-out fashion through holes formed adjacent the upper margin 24 of the pleated sheet 12. The ends 20 and 22 of drawstring 14 exit through adjacent holes at 16 and 18 so as to be tightenable and tieable after suitably reducing the circumference of the upper end 24 of the tubular-shaped pleated sheet 12. Alternately, the flexible cord 14 may be elastic and continuous.

Figure 2:
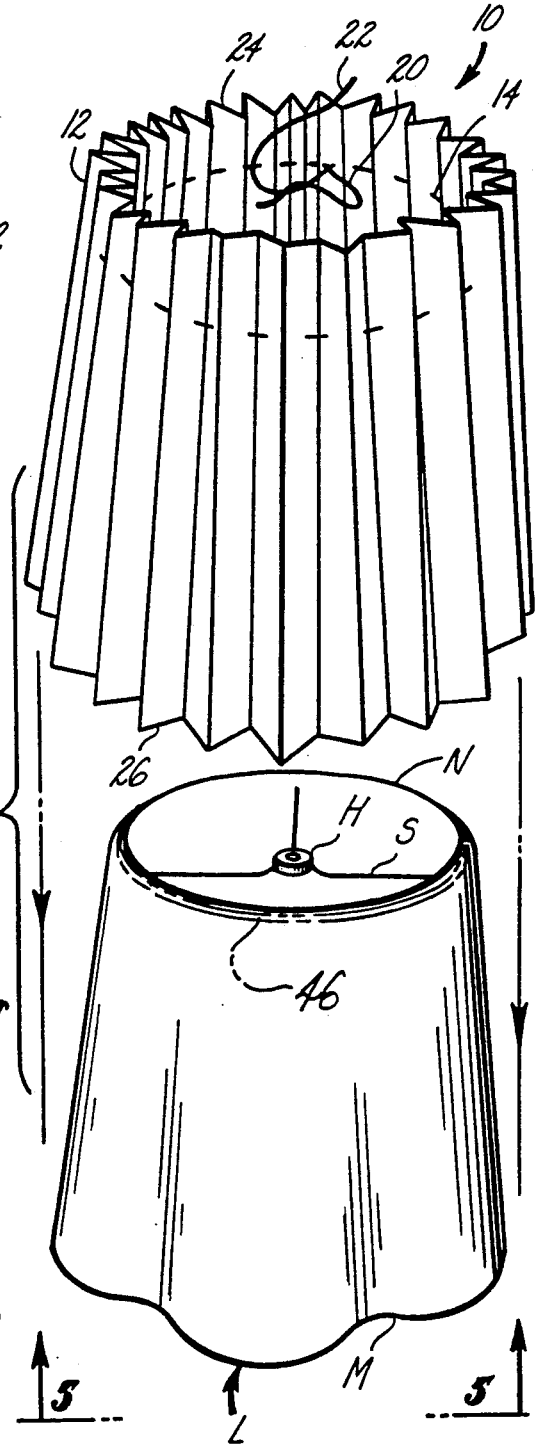
FIG. 2 is an exploded view of the invention shown in FIG. 1 fitted over a conventional lamp shade and showing an alternate attaching means in phantom.

Referring additionally to FIG. 2, the cover 10 is shown having drawstring 14 tensioned so as to have reduced the circumference of upper margin 24 ready for slidable fitting downwardly over a conventional lamp shade L. No further preparation is required to fit the cover 10 in snug position over and substantially or fully covering the lamp shade L. Because most lamp shades are tapered upwardly, coupled with the tensioning and securing of drawstring 14, the cover 10 will remain in position decoratively covering the lamp shade L, aided primarily by the force of gravity and surface friction between the inner surface of the device 10 and the outer surface of lamp shade L. However, this cover 10 will also function adequately when fitted over a cylindrical lamp shade.

Still referring to FIG. 2, in situations such as hotels and motels, it is desirable to render the invention 10 somewhat less easy to remove. To accomplish this, a strip of double-sided, preferably transparent or translucent adhesive tape 46, such as Style 950 manufactured by 3M Corp., is adhered around the lamp shade L immediately adjacent the upper margin N. Alternately, spaced segments of such double-sided tape may be so adhered. Thereafter, the device 10 may be fitted over the lamp shade L as previously described and then squeezed in the vicinity of the double-sided tape 46 to effect releasable adherence therebetween. By this means, the device 10 is held in place, even without the benefit of the drawstring 14 which may be removed in lieu of the double-sided tape 46, in which case there is no need to provide any drawstring holes as previously described.

Figure 4:
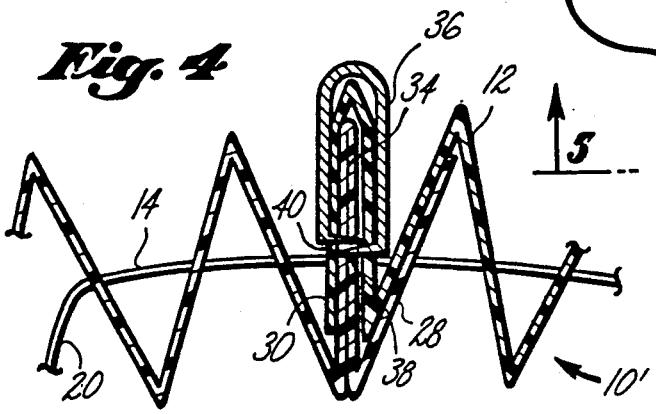
FIG. 4 is a section view similar to FIG. 3 showing an alternate connecting means between the free side margins of the pleated rectangular sheet.

Referring now to FIG. 4, an alternate embodiment of the connecting means between the edge panels 28 and 30 of the pleated sheet 12 is there depicted at 10'. This connecting means is in the form of a U-shaped metal or plastic clip 36 having opposing inwardly projecting barbs 38 and 40 which pierce through the corresponding layers of overlapping panel material to secure and maintain the tubular shape.

Figure 5:
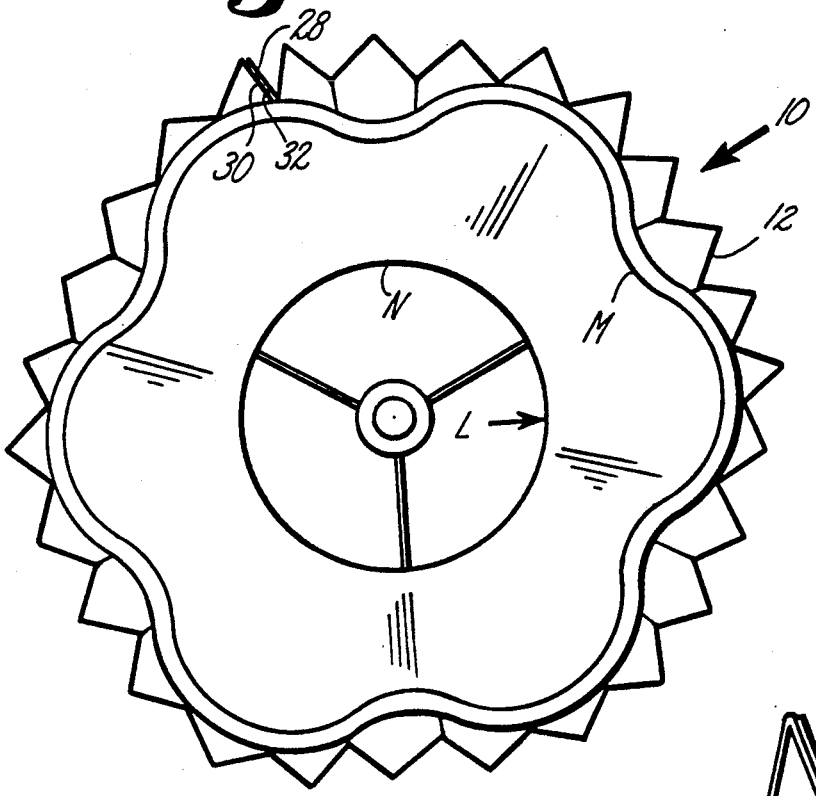
FIG. 5 is a view in the direction of arrows 5—5 in FIG. 2.
Figure 6:
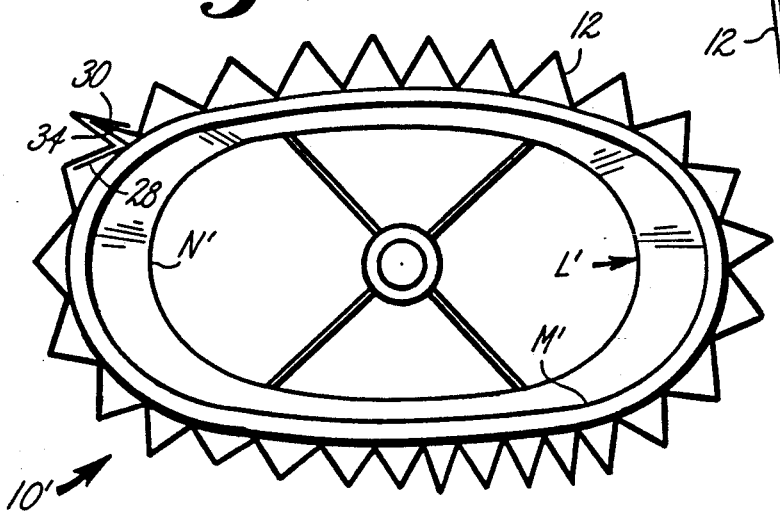
FIG. 6 is a view similar to FIG. 5 in conjunction with an irregularly shaped lamp shade.

Referring now to FIGS. 5 and 6, the compliability of the embodiments 10 and 10' of the invention around irregular shaped lamp shades L and L' each having its own distinctively shaped upper and lower margins N and M or N' and M1' is there shown. Thus, from the standpoint of both size and shape accommodation, either embodiment of the invention 10 or 10' is fully capable of expanding as required and exhibiting sufficient pliability so as to generally maintain the overall shape of the lamp shade L or L'.

Moreover, the length of the tubular member 12 may be selected so as to be substantially longer than the height of the lamp shade and drawstring 14 may be tensioned such that either the upper margin 24 or the lower margin 26 may extend either above, or below, the upper or lower margins, respectively of a lamp shade. Because of the relatively stiff nature of the pleated sheet, the overall tubular shape, in the form of a truncated cone as in FIG. 2, will uniformly extend the existing shape of the lamp shade itself so as to alter the decorative impact thereof.

Figure 7:
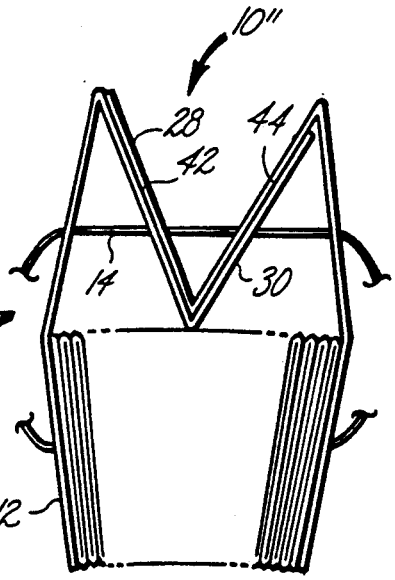
FIG. 7 is an end view of the invention in its stored configuration and showing yet another configuration for connecting the side margins of the pleated sheet.

Referring lastly to FIG. 7, the invention is shown in another alternate form at 10'' in its fully folded or stored configuration. In this embodiment 10'', the same pleated sheet 12 is adhered along overlapping edge panels 28 and 30 and the panel adjacent to each so as to increase the overall strength of the tubular shape.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A universal foldable lamp shade cover comprising:

a uniformly pleated rectangular sheet of thin, bendable material;

said pleated sheet defined by a plurality of side-by-side slender elongated rectangular panels integrally connected one to another in accordion fashion along a fold line between each said pleated panel ending in an end panel at each end of said pleated sheet;

means for connecting said end panels together to form a generally tubular member;

said tubular member having a relaxed circumference sized to fit around a lamp shade;

a strip of double-sided adhesive tape adherable on one side thereof around and immediately adjacent an upper opening of the lamp shade whereby an exposed side of said adhesive tape is presented;

said tubular member, being manually reducible in circumference at its upper end so as to be adhesively connected to said adhesive tape exposed side by pressing there against, resting over and substantially covering the lamp shade, remaining thusly only by adhesion and gravity against said adhesive tape exposed side.

2. A universal foldable lamp shade cover as set forth in claim 1, wherein:

said connection means is adhesive.

3. A universal foldable lamp shade cover as set forth in claim 1, wherein:

said connecting means is a self-engaging barbed clip.

4. A universal foldable lamp cover as set forth in claim 1, wherein:

said tubular member is sized to expand and fit over a wide range of circumferences of lamp shades.

5. A universal lamp shade cover as set forth in claim 1, wherein:

said tubular member has a length substantially longer than the height of the lamp shade.

6. A universal foldable lamp shade cover as set forth in claim 1, wherein:

said tubular member is sufficiently compliant along said fold lines to conform around non-circular lamp shades.

7. A universal foldable lamp shade cover as set forth in claim 1, wherein:

said tubular member is collapsible along said fold lines into a compressed configuration for storage.

8. In combination, a lamp shade cover cooperatively structured to loosely fit over and be supported only by a lamp shade, said lamp shade cover comprising:

a uniformly pleated rectangular sheet of thin, bendable material;

said pleated sheet defined by a plurality of side-by-side slender elongated rectangular panels integrally connected one to another in accordion fashion along a fold line between each said pleated panel ending in an end panel at each end of said pleated sheet;

means for connecting said end panels together to form a generally tubular member;

said tubular member having a relaxed circumference sized to fit around said lamp shade;

a strip of double-sided adhesive tape adherable on one side thereof around and immediately adjacent an upper opening of the lamp shade whereby an exposed side of said adhesive tape is presented;

said tubular member reducible in circumference at its upper end and manually adherable against said adhesive tape exposed side to provide an only means for supporting said tubular member in position over said lamp shade whereby said tubular member substantially covers the lamp shade, remaining thusly primarily by the force of gravity and adhesion against said adhesive tape exposed side.

9. A method of releasibly attaching a foldable lamp shade cover over and onto a lamp shade, said cover includung a uniformly pleated rectangular sheet of thin, bendable material, said pleated sheet defined by a plurality of side-by-side slender elongated rectangular panels integrally connected one to another in accordion fashion along a fold line between each said pleated panel ending in an end panel at each end of said pleated sheet, means for connecting said end panels together to form a generally tubular member, said tubular member having a relaxed circumference sized to fit around an upwardly tapering lamp shade, said method comprising the steps of:

A. ahdering one side of a strip of double-sided adhesive tape around said lamp shade immediately adjacent an upper opening of said lamp shade thereby presenting an exposed side of said adhesive tape;

B. fitting said cover over said lamp shade to properly position the respective upper and lower margins of said cover and lamp shade;

C. manually adhering the corresponding inner surface of said cover against said adhesive tape exposed side by pressing and squeezing of said cover against said lamp shade in the region of said adhesive tape.

* * * * *